United States Patent [19]

Currin

[11] Patent Number: 5,065,460

[45] Date of Patent: Nov. 19, 1991

[54] COMMODE SEAT LIFTING APPARATUS

[76] Inventor: Debra L. Currin, 715 E. Elm St., Hanford, Calif. 93230

[21] Appl. No.: 574,884

[22] Filed: Aug. 30, 1990

[51] Int. Cl.[5] ..... A47K 13/10

[52] U.S. Cl. ..... 4/251

[58] Field of Search ..... 4/251

[56] References Cited

U.S. PATENT DOCUMENTS 4,129,907 12/1978 Vaughan et al. ..... 4/251
4,574,401 3/1986 Nakajima ..... 4/251
4,979,238 12/1990 Clark ..... 4/251

*Primary Examiner*—Charles E. Phillips
*Attorney, Agent, or Firm*—Leon Gilden

[57] ABSTRACT

Apparatus including a handle arrangement for lifting of a commode seat wherein the handle may be mounted to a side or bottom surface of the associated commode seat to permit ease of lifting and manipulation thereof. Modifications of the invention include a lifting handle providing a support roll for use in combination the rotatable mounting of a tissue roll to permit dispensing thereof wherein replacement support tube permits use of a handle or selectively of a sponge applicator member for the dispensing of a disinfectant therefrom.

3 Claims, 5 Drawing Sheets

FIG. 3
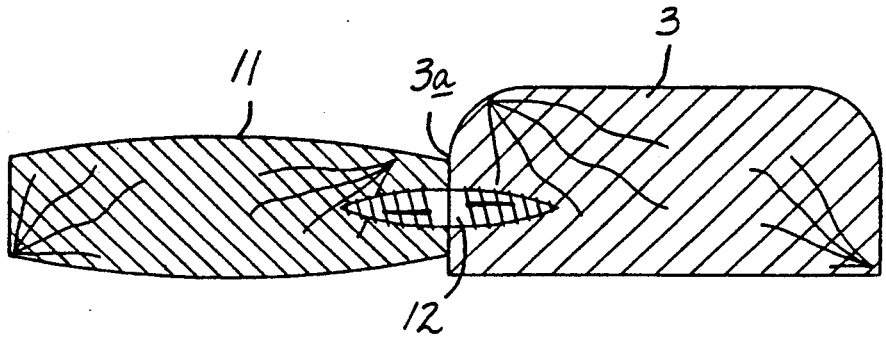
FIG. 4
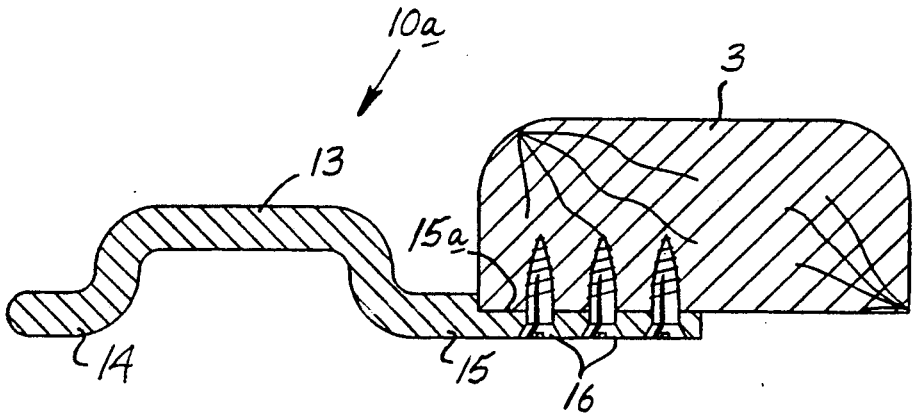
FIG. 5 FIG. 5

3
3a
19
17
18
10c 3a
3
10b
20
21a
26
27
DISINFECTANT

COMMODE SEAT LIFTING APPARATUS

BACKGROUND OF THE INVENTION

1. Field of the Invention

The field of invention relates to commode seat apparatus, and more particularly pertains to a new and improved commode seat lifting apparatus wherein the same permits selective and convenience of lifting of a commode seat in a sanitary and convenient relationship therewith.

2. Description of the Prior Art

Commode seat lifting arrangements have been utilized in the prior art. Heretofore however such arrangements have been of a unitary purpose or of a construction limiting their application for in combination with the associated commode seat. Examples of the prior art include U.S. Pat. No. 4,742,582 to GIALLOURAKIS wherein a planar seat member is mounted to a bottom surface of an associated commode seat wherein the planar member is of a configuration limiting manual grasping to the top and bottom surfaces thereof.

U.S. Pat. No. 4,805,246 to DEBARGAS et al sets forth a commode seat handle arranged for ease of mounting to a bottom surface of an associated commode seat further including a deodorant cake mounted therefrom extending into the commode organization.

U.S. Pat. No. 4,129,907 to VAUGHAN et al sets forth a commode seat handle arranged for mounting to a bottom surface of a commode seat utilizing a plurality of components to provide a support base for mounting of the handle exteriorly of the commode seat.

U.S. Pat. Nos. Des. 273,128 and 288,471 to RODDICK and GLADSTONE respectively provide handles for use and securement to associated commode seats for their lifting.

As such, it may be appreciated that there continues to be a need for a new and improved commode seat lifting apparatus as set forth by the instant invention wherein the same addresses both the problems of ease of use as well as effectiveness in construction and in this respect, the present invention substantially fulfills this need.

SUMMARY OF THE INVENTION

In view of the foregoing disadvantages inherent in the known types of commode seat lifting apparatus present in the prior art, the present invention provides a new and improved commode seat lifting wherein the same provides a handle organization arranged for mounting to a commode seat and extending laterally thereof to provide a manual grasping arrangement for an associated commode seat spaced therefrom. As such, the general purpose of the present invention, which will be described subsequently in greater detail, is to provide a new and improved commode seat lifting apparatus which has all the advantages of the prior art commode seat lifting apparatus and none of the disadvantages.

To attain this, the commode seat lifting apparatus of the instant invention includes apparatus including a handle arrangement for lifting of a commode seat wherein the handle may be mounted to a side or bottom surface of the associated commode seat to permit ease of lifting and manipulation thereof. Modifications of the invention include a lifting handle providing a support roll for use in combination the rotatable mounting of a tissue roll to permit dispensing thereof wherein replacement support tube permits use of a handle or selectively of a sponge applicator member for the dispensing of a disinfectant therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat lifting apparatus which has all the advantages of the prior art commode seat lifting apparatus and none of the disadvantages.

It is another object of the present invention to provide a new and improved commode seat lifting apparatus which may be easily and efficiently manufactured and marketed.

It is a further object of the present invention to provide a new and improved commode seat lifting apparatus which is of a durable and reliable construction.

An even further object of the present invention is to provide a new and improved commode seat lifting apparatus which is susceptible of a low cost of manufacture with regard to both materials and labor, and which accordingly is then susceptible of low prices of sale to the consuming public, thereby making such commode seat lifting apparatus economically available to the buying public.

Still yet another object of the present invention is to provide a new and improved commode seat lifting apparatus which provides in the apparatuses and methods of the prior art some of the advantages thereof, while simultaneously overcoming some of the disadvantages normally associated therewith.

Still another object of the present invention is to provide a new and improved commode seat lifting apparatus which may be compactly stored when not being utilized.

Yet another object of the present invention is to provide a new and improved commode seat lifting apparatus wherein the same provides for an organization for selective mounting of accessory organizations to include a support spool and disinfectant member selectively mounted to the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view taken along the lines 3—3 of FIG. 2 in the direction indicated by the arrows.

FIG. 4 is orthographic cross-sectional view of a modified commode seat lifting member utilized by the instant invention.

DESCRIPTION OF THE PREFERRED EMBODIMENT

Figure 1:
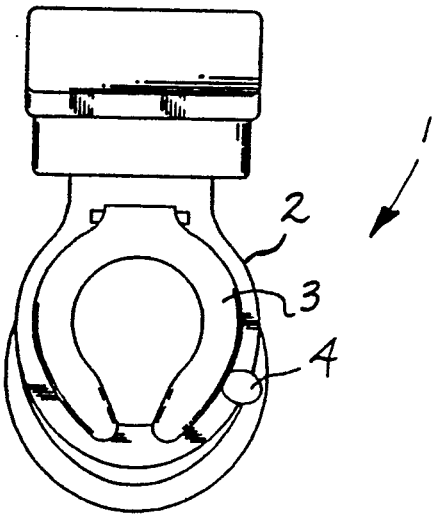
FIG. 1 is an isometric illustration of a prior art commode seat lifting apparatus.
Figure 2:
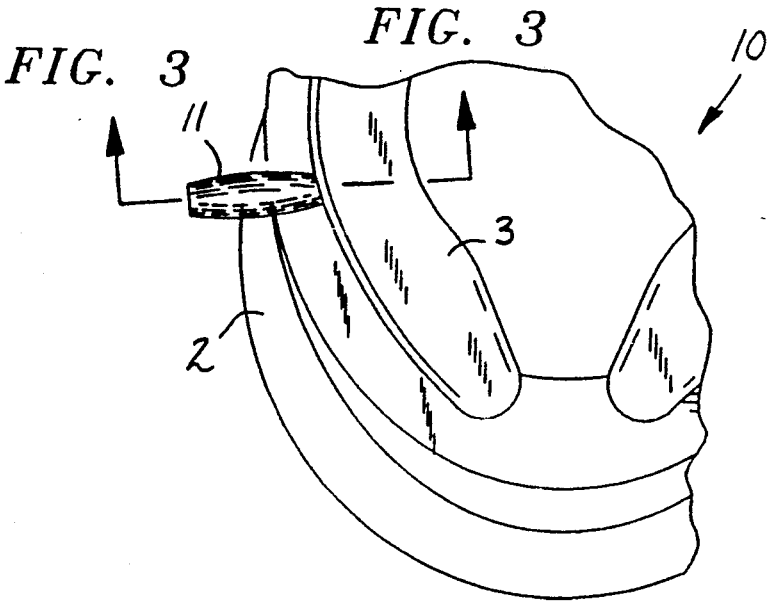
PRIOR ART FIG. 2
FIG. 2 is an isometric illustration partially in section of the instant invention mounted to an associated commode seat.
Figure 5:
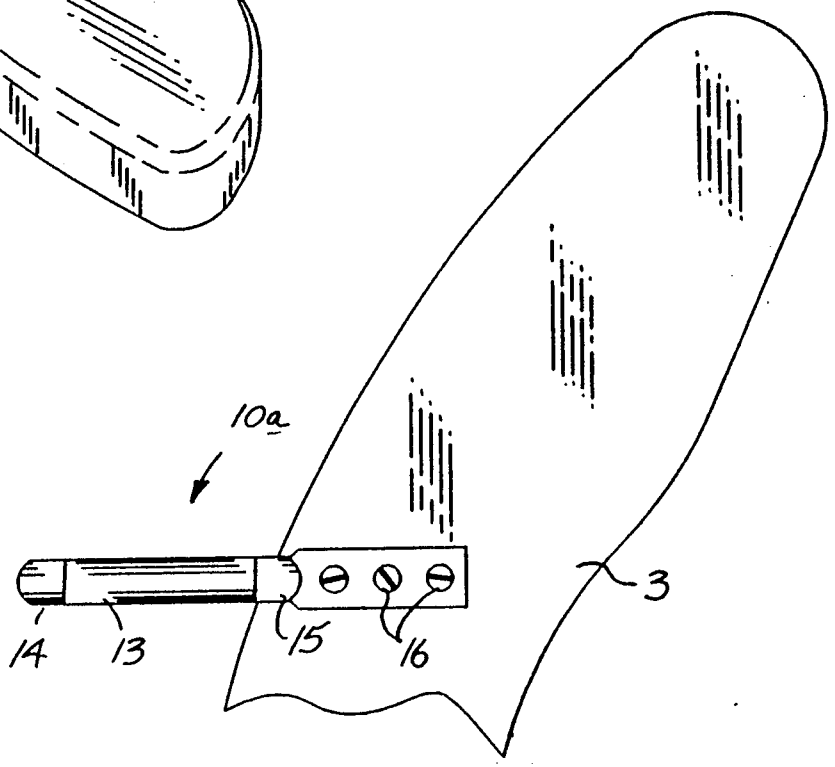
FIG. 5 is an orthographic view taken along the lines 5—5 of FIG. 4 in the direction indicated by the arrows.
Figure 6:
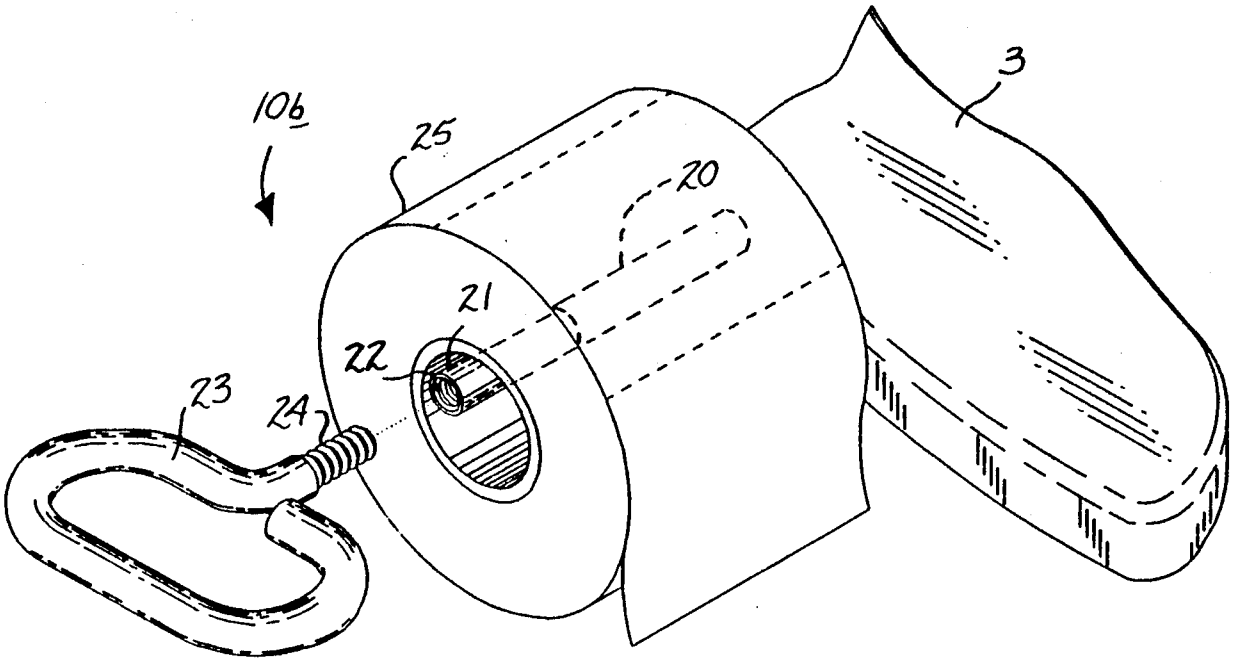
FIG. 6 is an isometric illustration of a further modified commode seat lifting apparatus utilized by the instant invention.

With reference now to the drawings, and in particular to FIGS. to 10 thereof, a new and improved commode seat lifting apparatus embodying the principles and concepts of the present invention and generally designated by the reference numerals 10, 10*a*, 10*b*, and 10*c* will be described.

FIG. 1 illustrates a prior art commode seat lifting apparatus 1 wherein a commode 2 pivotally mounts a commode seat 3 of a generally U-shaped configuration with the prior art lifting structure 4 defined as a generally elliptical planar member fixedly mounted to a bottom surface of the seat 3.

More specifically, the commode seat lifting apparatus 10 of the instant invention essentially comprises an elliptical handle including a threaded rigid shank 12 directed interiorly and coaxially of the elliptical handle 11 from a forward end thereof and simultaneously extending into the commode seat 3 laterally of the commode seat into a side surface thereof designated as side surface 3*a*. In this manner, the handle 11 extends laterally of and orthogonally relative to the side surface 3*a* to provide a convenient lifting handle or projection relative to the commode seat 2 to provide a sanitary lifting surface for manual grasping by an individual. FIG. 4 illustrates a modified handle structure defined as member 10*a* including a U-shaped handle with a central cylindrical web 13 of a generally cylindrical configuration with a first L-shaped leg 14 integrally mounted to a left end of the web 13 with a second L-shaped leg 15 integrally mounted to a right end of the web 13 wherein the second leg 15 includes an elongate extension with a recess 15*a* arranged to receive a bottom surface of the commode seat 3 with fastener 16 directed orthogonally through the extension into the bottom surface of the commode seat.

Figures 7, 8, 9:
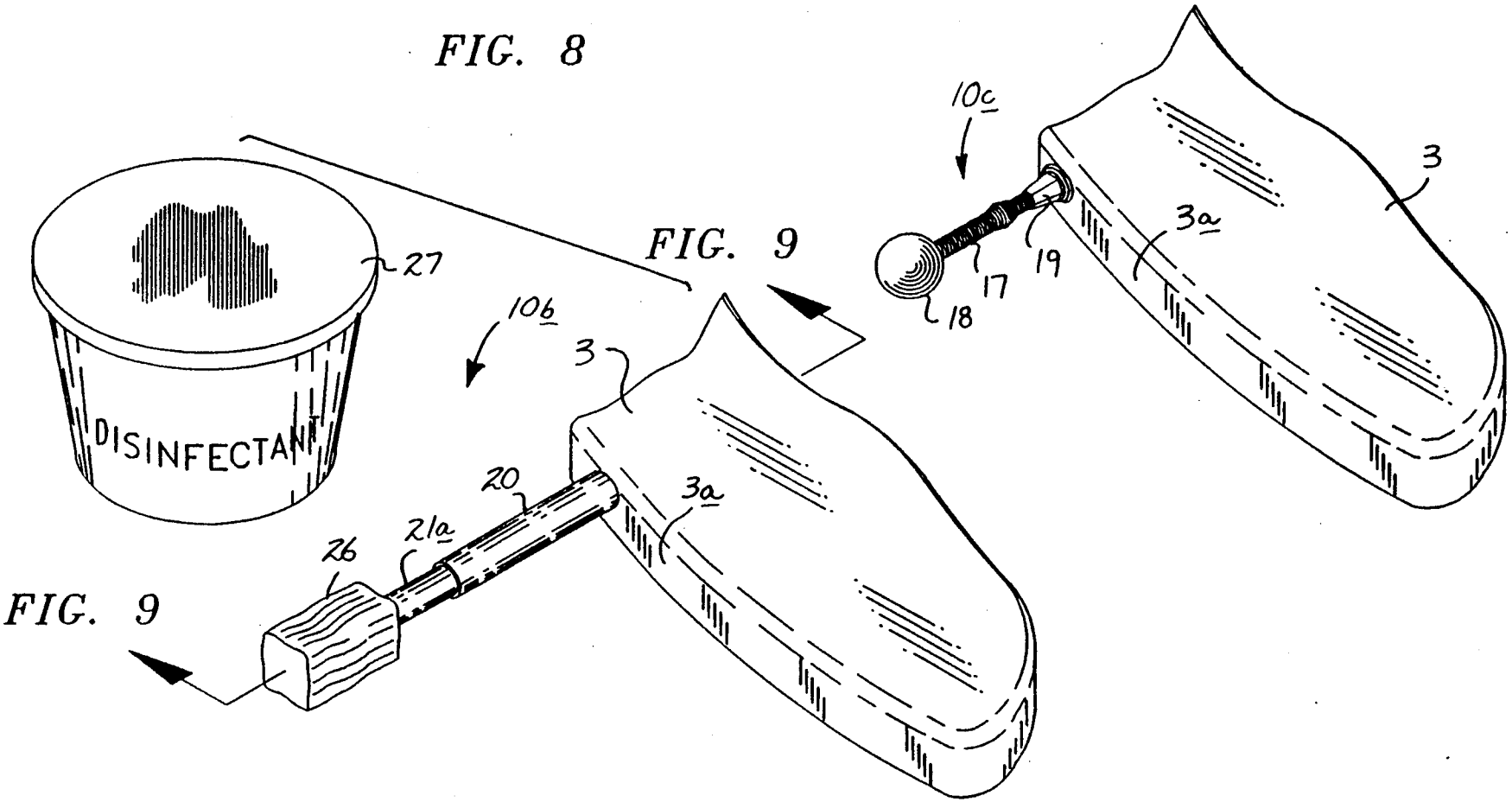
FIG. 7 is an isometric illustration of a further modified commode seat lifting apparatus utilized by the instant invention.
FIG. 8 is an isometric illustration of a commode seat lifting apparatus utilized by the instant invention providing for a support spindle utilized as a replacement for the support spindle as set forth in FIG. 6.
FIG. 9 is an orthographic view taken along the lines 9—9 of FIG. 8 in the direction indicated by the arrows.
Figure 9:
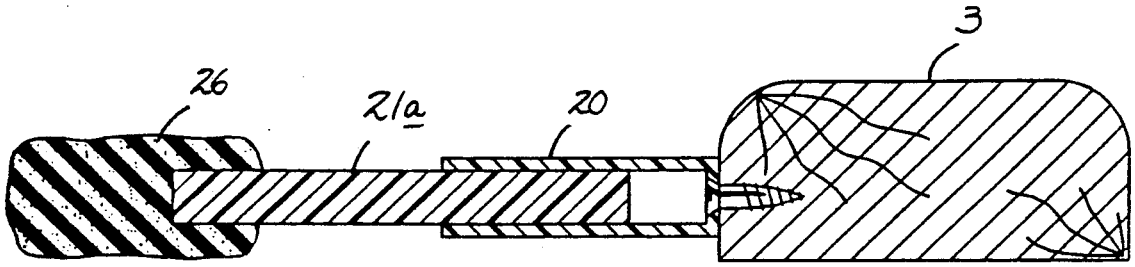

FIG. 7 illustrates a commode seat lifting apparatus 10*c* wherein the handle is defined with a coil spring body 17 coaxially aligned and axially mounted to a rigid base 19 that is in turn orthogonally secured to the side surface 3*a*. A resilient tip 18 is coaxially mounted to the coil spring body 17 remote from the base 19 to provide a grasping handle as well as a resiliently deflectable handle to prevent inadvertent accident by an individual engaging in accidental contact therewith.

Figure 10:
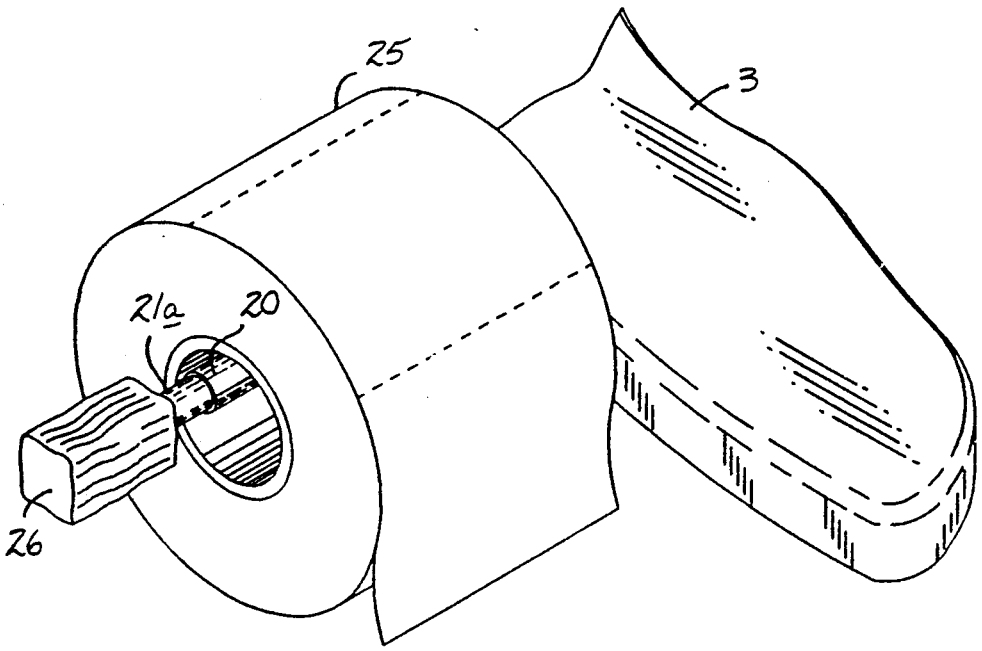
FIG. 10 is an isometric illustration of the commode seat lifting apparatus as set forth in FIG. 8 rotatably mounting a tissue roll thereon.

FIGS. 6, and 8 through 10 set forth a commode seat lifting apparatus 10*b* including a tubular sleeve 20 coaxially aligned and orthogonally mounted to the side surface 3*a* including a cylindrical coaxial cavity to frictionally receive a first tube support spindle 21 with a threaded free end 22 threadedly receiving a T-shaped handle 23 that includes a threaded handle shank 24 to threadedly engage the threaded free end 22 to thereby mount a tissue roll 25 in a rotatable manner for dispensing thereof adjacent a seat 3 in a form to provide a convenient manner of mounting the tissue roll 25. FIGS. 8 through 10 illustrate the apparatus 10*b* including a replacement spindle defined as a modified tube support spindle 21*a* to be frictionally received within the cylindrical cavity of the tube support spindle 21 that mounts a sponge tip 26 at a free end thereof wherein the sponge tip 26 extends axially and beyond the modified tube support 21*a* in a manner as illustrated in FIGS. 8 and 10. A disinfectant 27 is saturated into the sponge tip 26 to provide a convenient and sanitary grasping surface to effect convenient cleansing of an individual's hand subsequent to use of the commode as well as permitting removal of the modified tube support 21*a* to permit cleansing of various surfaces of the commode subsequent to use. It is understood that the tube support spindle 21 and the modified tube support spindle 21*a* are each of a complementary cross-sectional configuration to that defined by the cylindrical cavity of the tubular sleeve 20 to provide a frictional engagement between the sleeve 20 and the spindle 21 and modified spindle 21*a*.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode seat lifting apparatus comprising in combination a commode, the commode including an upper surface with a commode seat pivotally mounted to the upper surface, and the commode seat including a side surface, and a handle member mounted orthogonally to the side surface, and wherein the handle member is coaxially aligned, and wherein the handle member includes a tubular sleeve, the tubular sleeve defining a cylindrical cavity therewithin defined by a predetermined cross-sectional configuration, and a tube support spindle defined by an external configuration equal to the predetermined cross-sectional configuration frictionally received within the tubular sleeve, and the support spindle including a free end wherein the free end includes a threaded interior surface, and a "T" shaped handle wherein the "T" shaped handle including a threaded handle shank threadedly receivable within the threaded free end, and a tissue roll captured between the side surface and the "T" shaped handle.

2. Apparatus as set forth in claim 1 wherein the apparatus further includes a further tube support spindle, the further tube support spindle including a cross-sectional configuration equal to the predetermined cross-sectional configuration and selectively positionable within the cylindrical cavity when the tube support spindle is removed therefrom, and the further tube support spindle including a sponge tip positioned coaxially and integrally onto the tube support spindle.

3. Apparatus as set forth in claim 2 wherein the sponge tip includes a disinfectant fluid saturating the sponge tip, and the tissue roll securable between the sponge tip and the side surface.

* * * * *